US005431559A

United States Patent [19]

Taylor

[11] Patent Number: 5,431,559

[45] Date of Patent: Jul. 11, 1995

[54] OXYGEN-FUEL BURNER WITH STAGED OXYGEN SUPPLY

[75] Inventor: Curtis Taylor, Muncie, Ind.

[73] Assignee: Maxon Corporation, Muncie, Ind.

[21] Appl. No.: 92,008

[22] Filed: Jul. 15, 1993

[51] Int. Cl.[6] ..... F23D 11/44

[52] U.S. Cl. ..... 431/164; 431/10; 431/166; 431/188; 431/353; 239/422; 239/424.5

[58] Field of Search ..... 431/164, 165, 8, 9.10, 431/353, 350, 351, 186, 188, 187, 159; 239/422, 424.5, 402–405, 132.5

[56] References Cited

U.S. PATENT DOCUMENTS

| | | | |
|---|---|---|---|
| 4,351,632 | 9/1982 | Nagai | 431/353 |
| 4,690,635 | 9/1987 | Coppin | 431/187 |
| 4,986,748 | 1/1991 | Brown et al. | 431/188 |
| 5,092,760 | 3/1992 | Brown et al. | 431/10 |
| 5,269,679 | 12/1993 | Syska et al. | 431/9 |

FOREIGN PATENT DOCUMENTS

| | | | |
|---|---|---|---|
| 143307 | 11/1980 | Japan | 431/10 |
| 34006 | 4/1981 | Japan | 431/10 |
| 2048456 | 12/1980 | United Kingdom | 431/10 |

OTHER PUBLICATIONS

*North American Combustion Handbook,* A Basic Reference on The Art and Science of Industrial Heating with Gaseous and Liquid Fuels, vol. 1: Combustion, Fuels, Stoichiometry, Heat Transfer, Fluid Flow, Third Edition, "Oxygen Enrichment", pp. 76–79.

*Combustion Technology Manual,* Fourth Edition, 1988, "Oxygen-Enriched and Oxy-Fuel Combustion", pp. 316–327.

*Primary Examiner*—James C. Yeung

*Attorney, Agent, or Firm*—Barnes & Thornburg

[57] ABSTRACT

A burner assembly is provided for combining oxygen and fuel to produce a flame. The burner assembly includes a burner block including a combustion chamber and a nozzle discharging an oxygen and fuel mixture into a first stage region formed in the combustion chamber. First stage oxygen is supplied to the first stage region in the combustion chamber to combine with the oxygen and fuel mixture discharged into the first stage region by the nozzle. Second stage oxygen is also delivered to a downstream second stage region in the combustion chamber in sequence through an oxygen delivery tube, a flow regulator plate, and then an oxygen-conducting passage formed in the burner block. The flow regulator plate has a fixed-diameter oxygen-flow orifice having an internal diameter that is less than the internal diameter of the oxygen delivery tube to meter the flow of second stage oxygen discharged into the second stage region so as to apportion oxygen flow between the first and second stage regions.

24 Claims, 7 Drawing Sheets

OXYGEN-FUEL BURNER WITH STAGED OXYGEN SUPPLY

BACKGROUND AND SUMMARY OF THE INVENTION

The present invention relates to burner assemblies, and particularly to oxygen-fuel burner assemblies. More particularly, the present invention relates to a burner having a fuel-delivery system and a staged oxygen-supply system.

One challenge facing the burner industry is to design an improved burner that produces lower nitrogen oxide emissions during operation than conventional burners. Typically, an industrial burner discharges a mixture of fuel and either air or oxygen. A proper ratio of fuel and air is established to produce a combustible fuel and air mixture. Once ignited, this combustible mixture burns to produce a flame that can be used to heat various products in a wide variety of industrial applications. Combustion of fuels such as natural gas, oil, liquid propane gas, low BTU gases, and pulverized coals often produce several unwanted pollutant emissions such as nitrogen oxides ($NO_x$), carbon monoxide (CO), and total hydrocarbons (THC).

Burners that combine oxygen with an atomized fuel and oxygen mixture to produce a combustible mixture are known. See, for example, U.S. Pat. No. 5,092,760 to Brown and Coppin. Burners having oxygen-enrichment systems are also known as disclosed in the *IHEA Combustion Technology Manual,* Fourth Edition (1988/), pp. 320–21, published by The Industrial Heating Equipment Association of Arlington, Va.

Burners were developed to burn a mixture of fuel and pure oxygen in an attempt to lower the amount of $NO_x$ produced during combustion. Regular combustion air contains a lot of nitrogen ($N_2$) and pure oxygen contains no nitrogen. It has been observed that the higher flame temperatures brought on by burning a mixture of fuel and pure oxygen has caused the conversion of fuel-bound $N_2$ into $NO_x$ to increase.

A burner assembly designed to burn fuel more completely using a lower flame temperature would lead to lower nitrogen oxide emissions. What is needed is a burner assembly that is able to burn a fuel and oxygen mixture without generating a lot of unwanted nitrogen oxide emissions.

According to the present invention, a burner assembly is provided for combining oxygen and fuel to produce a flame. The burner assembly includes a burner block formed to include a combustion chamber having inlet and outlet openings and a nozzle positioned to discharge an oxygen and fuel mixture into the combustion chamber through the inlet opening.

Means is also provided for supplying supplemental oxygen to the combustion chamber through the inlet opening. This supplemental oxygen mixes with the oxygen and fuel mixture in a first stage region inside the combustion chamber. This combustible mixture can be ignited to define a flame having a root portion in the combustion chamber and a tip portion outside the combustion chamber.

The burner block is also formed to include oxygen-discharging means around the outlet opening of the combustion chamber and oxygen-conducting means for conducting oxygen along one or more paths through the burner block and outside of the combustion chamber to the oxygen-discharging means. Means is also provided for delivering oxygen into the oxygen-conducting means formed in the burner block so that it passes through the oxygen-discharging means and is ejected from the burner block into a downstream second stage region containing a portion of the flame and lying outside the combustion chamber.

In preferred embodiments, the burner block is made of a refractory material and includes an outside wall formed to include the combustion chamber inlet opening and a plurality of oxygen-admission ports around the inlet opening. The burner block also includes a furnace wall configured to lie in a furnace and formed to include the combustion chamber outlet opening and a plurality of oxygen-discharge ports around the outlet opening. Illustratively, the burner block is also formed to include a plurality of oxygen-conducting passageways. Each passageway extends through the burner body to connect one of the oxygen-admission ports to one of the oxygen-discharge ports. Essentially, these passageways are arranged to bypass the combustion chamber and deliver oxygen to the second stage region downstream of the combustion chamber. Illustratively, the second stage region lies in a furnace adjacent to the burner block and the flame produced by the burner assembly heats products in the furnace.

An oxygen-supply manifold is provided to hold temporarily a supply of pressurized combustion oxygen for use in the burner assembly. In use, a continuous stream of pressurized oxygen is admitted into the oxygen-supply manifold using any suitable means. Some of that pressurized oxygen is distributed to the first stage region by the supplying means and the rest of that pressurized oxygen is distributed by the delivering means to the second stage region using the oxygen-conducting passageways formed in the burner block.

The supplying means is defined by an annular channel that extends along the longitudinally extending central axis of the nozzle and between the oxygen-supply manifold and the combustion chamber. This annular channel provides a flow path for distributing some of the pressurized oxygen in the oxygen-supply manifold to the first stage region to mix with the atomized oxygen and fuel mixture discharged by the nozzle.

Illustratively, the delivering means includes a plurality of oxygen-delivery tubes arranged to connect the oxygen-supply manifold to the oxygen-conducting passageways formed in the burner block. Each oxygen-delivery tube includes inlet means for receiving oxygen extant in the oxygen-supply manifold and outlet means for discharging oxygen into the oxygen-conducting passageways through the oxygen-admission ports. This oxygen then passes through the passageways and is ejected into the second stage region through the oxygen-discharge ports. It is within the scope of this invention to employ one annular oxygen-discharge port rather than a plurality of spaced-apart oxygen-discharge ports.

The burner assembly in accordance with the present invention introduces combustion oxygen into two regions or combustion zones. The first stage combustion zone is near the root of the flame inside the combustion chamber and the second stage combustion zone is in the furnace itself in a location downstream from the combustion chamber and nearer to the tip of the flame. Advantageously, by withholding a portion of the combustion oxygen from the root of the flame, the fuel partially burns and the fuel-bound nitrogen is converted into reducing agents. These nitrogenous compounds are subsequently oxidized to elemental nitrogen, thereby minimizing the generation of fuel nitrogen oxides. Also, the peak flame temperature is lowered in the fuel-rich first stage combustion zone since the generated heat dissipates rapidly. This reduction in flame temperature reduces the formation of nitrogen oxides which are temperature-dependent. In the second stage combustion zone, additional oxygen is injected through the burner block oxygen-discharge ports to complete combustion and optimize flame shape and length.

Additional features and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
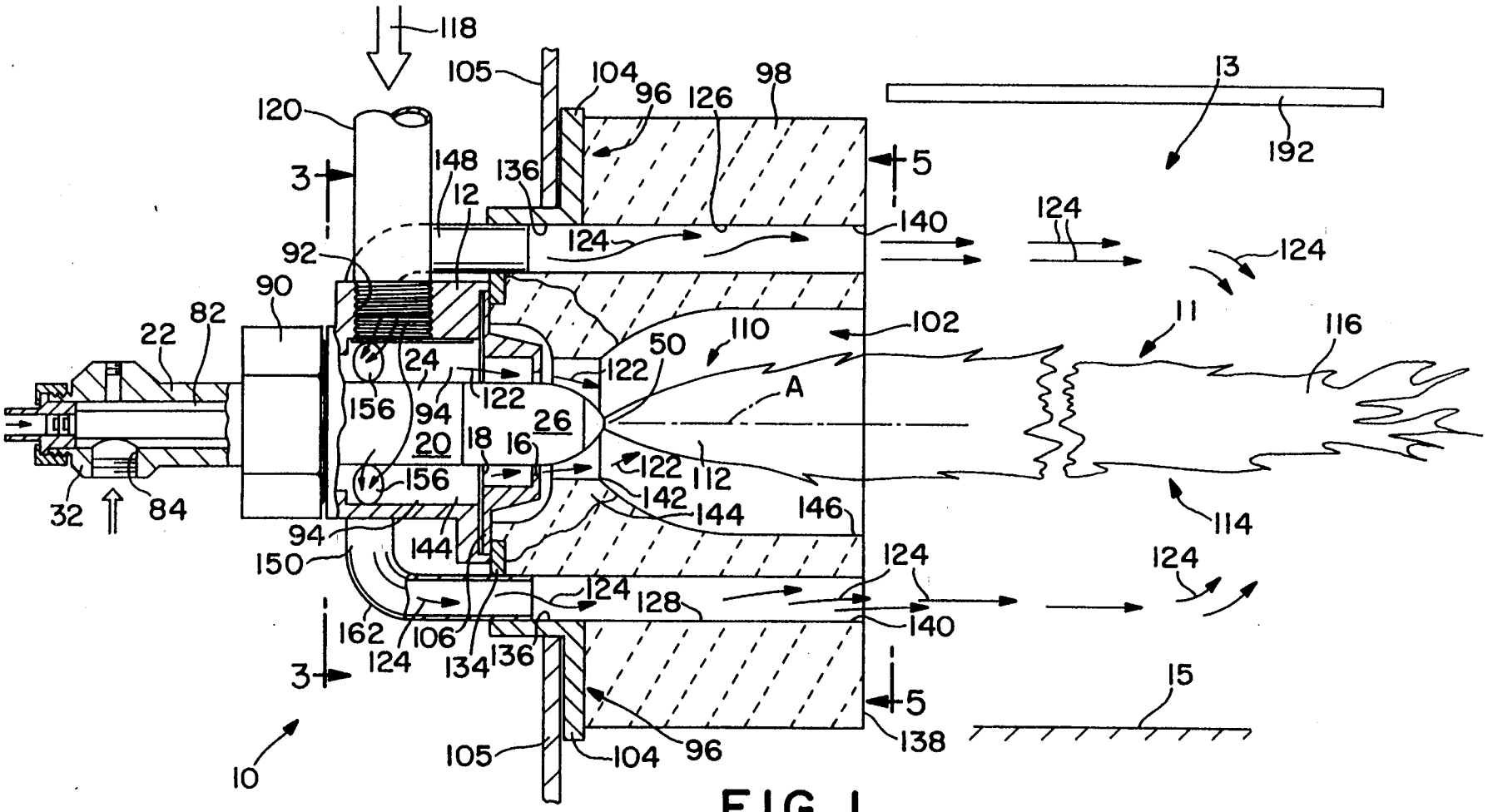
FIG. 1 is a side elevation view of a burner assembly in accordance with the present invention, with portions broken away, showing a burner block, a nozzle at the inlet end of a combustion chamber in the burner block, an oxygen-supply manifold around the nozzle, means for supplying oxygen from the oxygen-supply manifold around the nozzle and into a first stage combustion zone in the combustion chamber, and means for delivering oxygen to a second stage combustion zone downstream of the combustion chamber using tubes located outside the burner block and delivery passageways located in the burner block.

As shown in FIG. 1, a burner assembly 10 is used in industrial processes to produce a flame 11 that extends into a furnace 13. Various products 15 can be conveyed through the furnace 13 to be treated or processed using heat generated by flame 11. Burner assembly 10 is configured to heat products 15 conveyed through the furnace and to minimize the amount of nitrogen oxide produced during combustion. In particular, burner assembly 10 includes a staged oxygen supply system that operates to deliver some of the combustion oxygen to a first stage region near the root of flame 11 and the rest of the combustion oxygen to a second stage region at a point closer to the tip of flame 11. By diverting some of the combustion oxygen toward the tip of flame 11, it is possible to reduce nitrogen oxide emissions. Burner assembly 10 can be used in a wide variety of applications due to its enhanced emissions performance.

Figure 2:
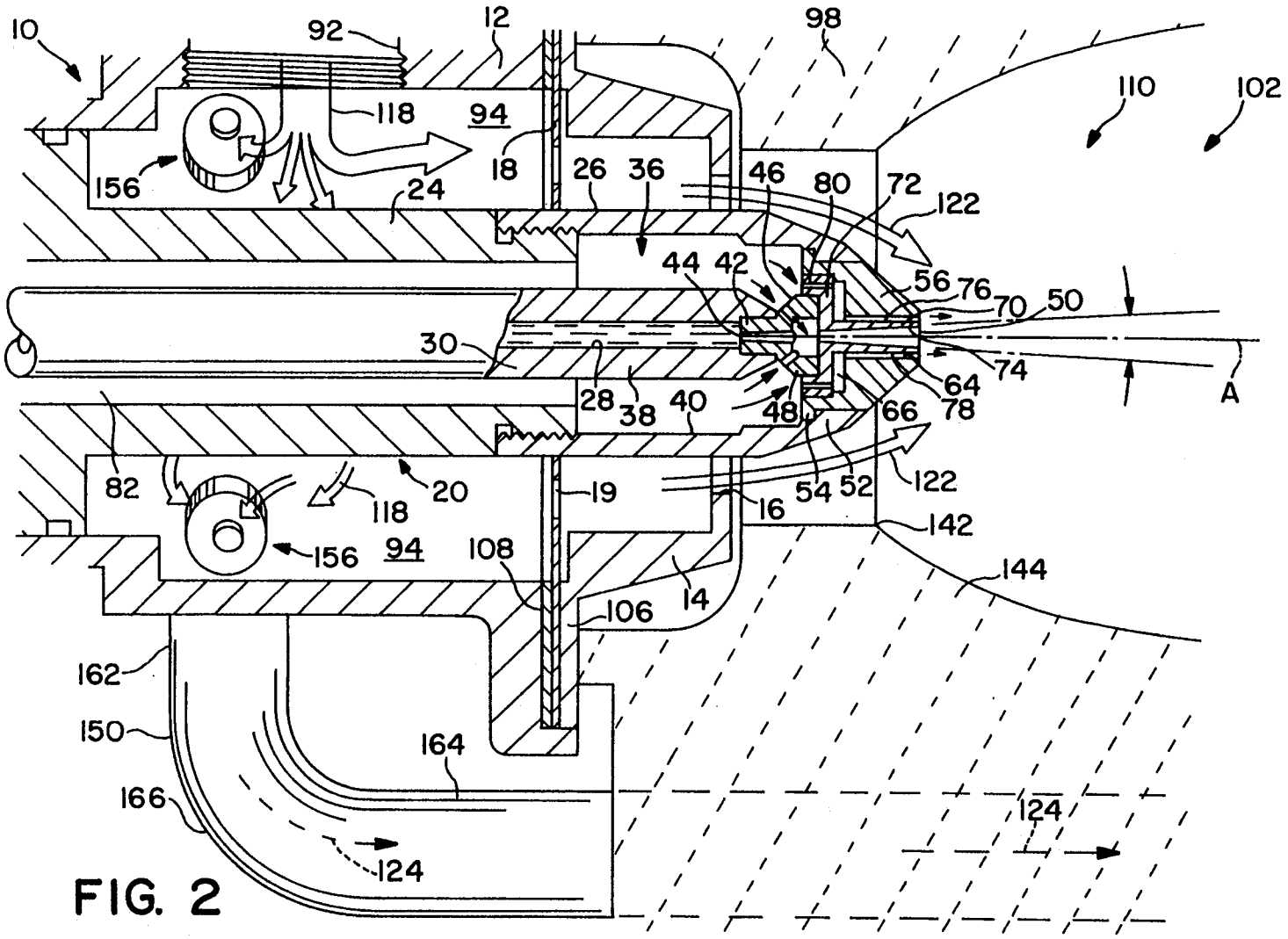
FIG. 2 is an enlarged view of the nozzle and the environment surrounding the nozzle, showing means in the nozzle for mixing oxygen and fuel to produce an atomized oxygen and fuel mixture that can be discharged from the nozzle into the first stage combustion zone to mix with supplemental oxygen received from the oxygen-supply manifold.

As shown in FIGS. 1 and 2, the burner assembly 10 includes a housing 12 having a nose portion or nose piece 14 provided with a central discharge orifice or annular opening 16. A fuel or oil delivery assembly 20 is shown centrally mounted within the housing 12 by means of a spider or centering ring 18. The fuel delivery assembly 20 is shown to include an inlet body portion 22, a central body portion 24, and a burner tip portion 26. A central fuel-oil passageway 28, formed in a channel member 30, is provided with an inlet connector 32 for receiving a suitable supply of fuel such as oil. The central fuel-oil passageway 28 extends through the fuel delivery assembly 20 along a central axis A.

The burner tip portion 26 forms a chamber 36 between a forward channel portion 38 of the channel member 30 and the inner circumferential wall portion 40 of the burner tip portion 26. As shown more particularly in FIG. 2, an atomizing member 42 is secured to an outlet end of the forward channel portion 38 and projects within the central fuel-oil passageway 28. The atomizing member 42 has a central passageway or oil port 44 communicating with the central fuel-oil passageway 28, which is coaxial with the axis A of the central fuel-oil passageway. The atomizing member has diverging wall portions 46 provided with atomizing ports 48 which converge toward the central axis A adjacent the outlet of oil port 44.

The forward end of the burner tip portion 26 terminates at its outer end in a burner tip opening 50, which is stepped internally at 52 to receive a flange 54 of an annular radiation shield 56. The radiation shield 56 has a central opening 64 communicating with a recessed portion 66.

A discharge cone 70 is positioned within the central opening 64 of the radiation shield 56. The discharge cone 70 has a retaining flange 72 which is positioned between the atomizing member 42 and the radiation shield 56. The discharge cone 70 has an inner conical surface 74, concentric with axis A, which diverges outwardly toward the burner tip opening 50, permitting the atomized fuel to expand adjacent the outlet end of the fuel delivery assembly 20. An outer surface 76 of the discharge cone is spaced apart from an inner surface portion of the central opening 64 so as to form an annular passage 78 between the discharge cone 70 and the annular radiation shield 56 adjacent the burner tip. The annular passage 78 extends concentrically with, and accordingly parallel to, the central axis A of the central fuel-oil passageway 28 and oil port 44. The annular recess 66, formed in the radiation shield 56, communicates with a plurality of ports 80 formed in the retaining flange portion 72 of the discharge cone 70, which ports are in open communication with the chamber 36. The annular recess 66 is not only in communication with the plurality of ports 80, but also the annular passage 78 formed between the discharge cone 70 and the annular radiation shield 56.

An atomizing fluid passage 82 extends through the inlet body portion 22 and central body portion 24 of the fuel assembly 20 exteriorly of channel member 30, and communicates at its outlet end with the chamber 36 formed between the burner tip portion 26 and the channel member 30. The atomizing fluid passage 82 is provided at its inlet end with a connector 84 for receiving a suitable supply of atomizing fluid. As shown particularly in FIG. 2, the centering ring or spider 18 is provided with a plurality of openings or ports 19 for the flow of oxygen outwardly along the outer surface of burner tip portion 26. The outer surface of the burner tip portion 26 between the centering ring 18, and the radiation shield 56, is tapered at about 4° to provide a smooth transition flow for the combustion oxygen to the radiation shield 56.

As shown particularly in FIG. 1, the fuel delivery assembly 20 is positioned with its central body portion 24 within the housing 12, and with the burner tip portion 26 axially centered with and extending outwardly through the central annular opening 16, such that the annular discharge orifice 16 is coaxial with the axis A of the central fuel-oil passageway 28. The central body portion 24 is shown being provided with flange portions (not shown) having one or more O-rings (not shown) positioned therewithin for sealing the oil delivery assembly 20 with an inner lip portion 90 of the housing 12.

An oxygen inlet 92 is provided within the housing 12 and communicates with an oxygen-supply manifold 94 which surrounds the central body portion 24 and the burner tip portion 26 of the fuel delivery assembly 20. A first portion of the oxygen supplied to the manifold 94 exits through the plurality of oxygen ports or openings 19 formed in the spider or centering ring 18, so as to provide an oxygen envelope about the atomized oil discharged from the outlet end 50 of the fuel assembly 20. A remaining portion of the oxygen supplied to the manifold 94 is diverted to flow along a different path to reach flame 11 in the manner described below. Such diversion of combustion oxygen flow is an important feature of the staged oxygen-fuel burner assembly 10 and contributes to the lowered nitrogen oxide emissions achieved by the burner assembly 10.

As shown in FIG. 2, the burner tip portion 26 is not only centered within the nose portion 14 of the housing, but also projects through and extends outwardly beyond the central discharge orifice 16 formed in the nose piece 14 of the housing 12. In view of the fact that the oxygen discharged through orifice 16 must flow along the tapered outer surface of the burner tip portion 26 for a distance of up to about $1\frac{1}{4}$ inches, there is a delayed combustion produced between the atomized fuel particles supplied through the discharge cone 70 and the oxygen supplied through the central orifice 16 of the nose piece 14 surrounding the tip, thereby lowering the burner tip temperature to satisfactory levels.

The housing 12, as shown in FIGS. 1 and 2, is connected to a retainer or support block holder 96 having a refractory burner block 98 retained in position with a suitable cement (not shown). The burner block 98 is made of, for example, zirconia and formed to include a longitudinally extending and diverging combustion chamber 102. The retainer or support block holder 96 has a flange portion 104 for attachment to the wall 105 of furnace 13. The nose piece 14 has a mounting flange 106 adjacent its inlet end, which is suitably secured to the housing 12 and a gasket 108 is provided therebetween.

As shown in FIG. 1, the burner assembly 10 is configured to provide a first stage combustion zone 110 in a region inside combustion chamber 102 near the root 112 of flame 11 and a second stage combustion zone 114 in a region inside furnace 13 and outside of the combustion chamber 102 toward the tip 116 of flame 11. A continuous stream of combustion oxygen 118 is supplied to oxygen-supply manifold 94 through supply pipe 120 to ensure that manifold 94 always contains pressurized oxygen. A first stream 122 of combustion oxygen is discharged from manifold 94 into the first stage combustion zone 110 through central discharge orifice 16 in nose portion 14 as described above. A second stream 124 of combustion oxygen is discharged from manifold 94 into the second stage combustion zone 114 through several passageways bypassing the combustion chamber 102 as shown in FIG. 1.

Figure 5:
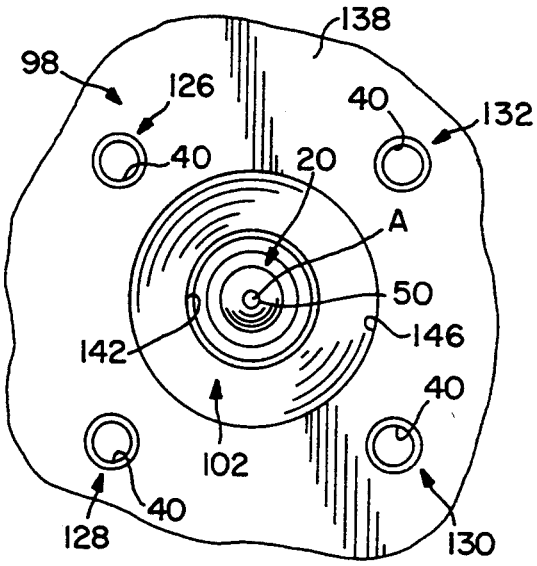
FIG. 5 is a partial front elevation view taken along line 5—5 of FIG. 1 showing four oxygen-discharge ports formed in the furnace wall of the burner block and arranged to lie about the nozzle.

As shown in FIGS. 1 and 5, burner block 98 is formed to include four longitudinally extending passageways 126, 128, 130, and 132 for conducting the second stream 124 of combustion oxygen to the second stage combustion zone 114 without passing through the combustion chamber 102 formed in the burner block 98. Burner block 98 includes an outside wall 134 that is formed to include an inlet opening 136 into each of the oxygen-conducting passageways 126, 128, 130, and 132 and a furnace wall 138 that is formed to include an outlet opening 140 for each of the oxygen-conducting passageways 126, 128, 130, and 132. The combustion chamber 102 has an inlet opening 142 formed in an inner portion 144 of burner block 98 and an outlet opening 146 formed in furnace wall 138 of burner block 98. As shown in FIG. 5, the four outlet openings 140 are arranged in uniformly circumferentially spaced-apart relation around the nozzle 26 and the inlet opening 142 of the combustion chamber 102. The four outlet openings are also arranged to lie in radially equidistant relation from the burner tip opening 50 and axis A as shown best in FIG. 5.

Figure 3:
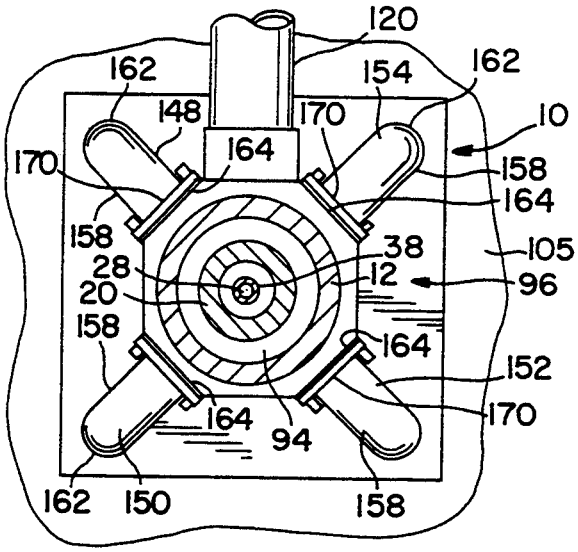
FIG. 3 is a section taken along line 3—3 of FIG. 1 showing a portion of the nozzle in the oxygen-supply manifold and four oxygen-delivery tubes extending from the oxygen-supply manifold to the burner block.

Four elbow-shaped oxygen-delivery tubes 148, 150, 152, and 154 are provided as shown in FIGS. 1–3 to conduct the second stream 124 of combustion oxygen from outlets 156 formed in the oxygen-supply manifold 94 to the oxygen-conducting passageways 126, 128, 130, and 132 formed in the burner block 98. Although these tubes 148, 150, 152, and 154 are illustrated as having an "elbow-type" shape, it is within the scope of this invention to form said tubes in any shape or to provide internal passageways (not shown) interconnecting the oxygen-supply manifold 94 and the oxygen-conducting passageways 126, 128, 130, and 132. Each oxygen-delivery tube 148, 150, 152, and 154 illustratively includes an inlet end 158, an outlet end 160, and an annular portion 162 between the inlet and outlet ends 158, 160. It will be understood that the number and shape of the oxygen-delivery tubes can vary depending upon the application and also upon the location of the manifold 94 and the inlet openings 142 into the oxygen-conducting passageways formed in the burner block 98.

Figure 4:
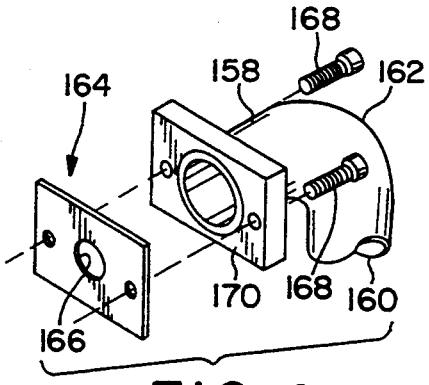
FIG. 4 is an exploded perspective view of an oxygen flow regulator plate of the type shown in FIG. 3 and positioned between the oxygen-supply manifold and each of the oxygen-delivery tubes.

Various means are provided to regulate the flow of oxygen through the oxygen-delivery tubes 148, 150, 152, and 154 and passageways 128, 130, 132, and 134. A flow regulator plate 164 is formed to include an aperture 166 having an internal diameter that is less than the internal diameter of the adjacent oxygen-delivery tube 128, 130, 132, and/or 134 as shown, for example, in FIG. 4. Bolts 168 can be used to fix each flow regulator plate 164 in position between housing 12 and a mounting plate 170 attached to an oxygen-delivery tube. It is within the scope of the invention to vary the size of aperture 166 and the location and number of the flow regulator plates 164 to regulate the flow of the second stream 124 of combustion oxygen. It will be understood that these plates 164 provide suitable valve means for controlling and regulating oxygen flow discharged into the second stage combustion zone 114.

It is also within the scope of the present invention to vary the location, number, shape, and pattern of oxygen-conducting passageways formed in the burner block 98. For example, the burner block could be formed to include a single cylindrical oxygen-conducting passageway (not shown) around the combustion chamber 102 and fed by one or more inlet openings formed in the burner block. Alternatively, one or more oxygen-conducting passageways could deliver oxygen to a central manifold (not shown) formed in the burner block and separate from the combustion chamber 102 and the central manifold would dispense oxygen into the second stage combustion zone 114 through one or more outlet openings formed in the burner block.

It is also within the scope of the present invention to vary the amount of oxygen discharged into the second stage combustion zone 114. For example, in a presently preferred embodiment, 50% of the oxygen needed for combustion is introduced into the second stage combustion zone 114. Other suitable oxygen distribution variations are shown, for example, in FIG. 10.

Figure 6:
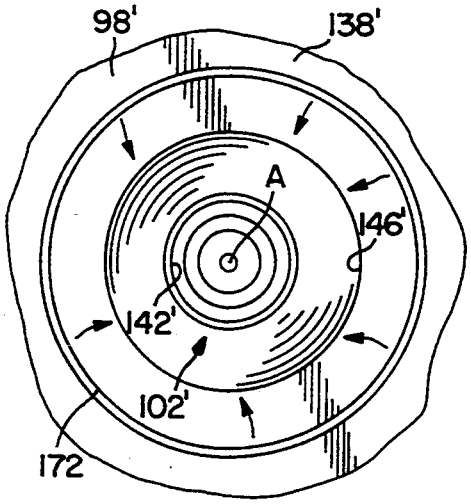
FIG. 6 is a view similar to FIG. 5 showing an alternative embodiment of a burner block wherein an annular oxygen-discharge port is formed in the furnace wall and arranged to surround the nozzle.

An alternative oxygen-discharging design is shown in FIG. 6. In this embodiment, the four spaced-apart outlet openings 140 of oxygen-conducting passageways 126, 128, 130, and 132 are replaced by an annular oxygen-discharge port 172 formed in an alternative burner block 98'. It will be understood that any suitable passageway system could be formed in burner block 98' to discharge oxygen through annular port 172. Furthermore, two or more annular port sections (not shown) could be used in lieu of single annular port 172.

Figure 8:
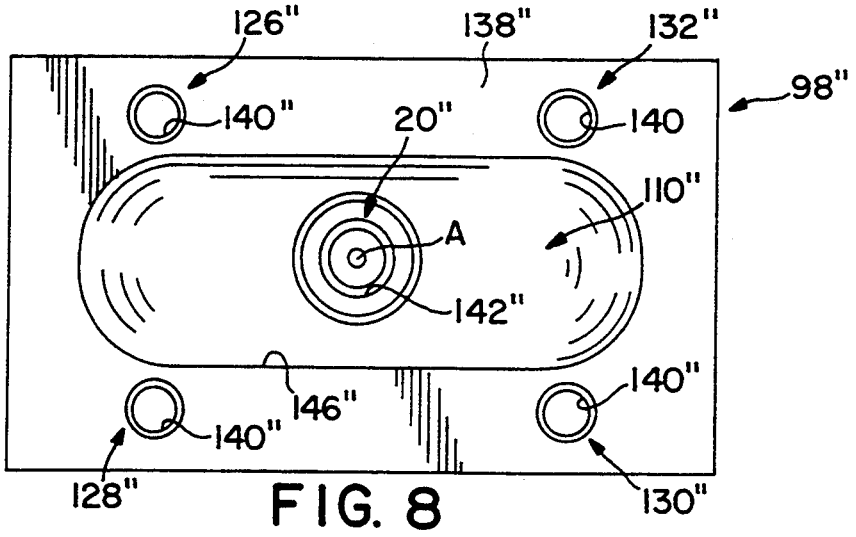
FIG. 8 is a view similar to FIGS. 5 and 6 showing still another embodiment of a burner block wherein four oxygen-discharge ports are arranged to lie about an oblong or rectangular combustion chamber to produce a flat flame.

An alternative burner block design is shown in FIG. 8. Illustratively, a burner block 98" is formed to include an oblong or long rectangular combustion chamber 102" and four outlet openings 140" around combustion chamber 102".

In operation, a suitable fuel such as oil is supplied to the inlet connector 32 of the central oil passageway 28 and flows along the passageway 28 into the oil port 44 of the atomizing member 42. Simultaneously, an atomizing fluid medium is supplied to connector 84 and flows through atomizing passage 82 into chamber 36. From chamber 36, a portion of the atomizing fluid medium flows through the plurality of atomizing ports 48 in the diverging walls 46 of the atomizing member 42 to impinge upon the axial flow of oil passing through the central oil port passageway 44, so as to atomize the oil into a plurality of minute particles. The atomized oil particles then expand within the discharge cone 70 as they leave the outlet end of the fuel assembly 20 adjacent the burner tip opening 50. However, a portion of the atomizing fluid medium is also delivered through the plurality of ports 80 in the retaining flange portion 72 of the discharge cone 70, through the annular recess 66, and outwardly through the annular passage 78 to form a boundary layer cooling annulus about the atomized oil particles discharged from the burner opening 50.

The boundary layer cooling annulus of atomizing fluid media, formed by the annular passage 78, flows concentrically about the discharged atomized oil particles and coaxially with the axis of the central oil passageway and oil port 44. The boundary layer cooling annulus not only functions to stabilize the flow of atomized oil particles discharged from outlet 50 and restrains the eddying of such minute oil particles from collecting on the radiation shield 56, but also cools the radiation shield 56 and the discharge cone 70, and precludes the fuel from cracking in the atomizing chamber. It is important that the oil particles do not collect on the radiation shield 56, since any collection of carbon becomes a fuel source, particularly in the presence of oxygen, with the resultant release of damaging quantities of heat.

Simultaneously with the discharge of the minute atomized oil particles from the outlet end of the fuel assembly 20, a continuous envelope of commercially pure oxygen is supplied as first stream 122 from the oxygen supply chamber 94 and through the openings or oxygen flow ports 19 of centering ring 18 to surround and encompass the discharged atomized oil particles, to form a combustible mixture and produce a desired burner flame. The first stream 122 of oxygen mixes with the atomized fuel and oxygen mixture in the first stage combustion zone 110 in combustion chamber 102.

A second stream of combustion oxygen is conducted from the oxygen-supply manifold 94 to the second stage combustion zone 114 in furnace 13 through the oxygen-delivery tubes 148, 150, 152, and 154 and the oxygen-delivery passageways 126, 128, 130, and 132. The advantage is that by withholding a portion of the combustion oxygen from the root 112 of flame 11, the fuel partially burns and the fuel-bound nitrogen is converted into reducing agents. These nitrogenous compounds are subsequently oxidized to elemental nitrogen, thereby minimizing the generation of fuel nitrogen oxides. Also, the peak flame temperature is lowered in the fuel-rich first stage combustion zone 110, since the generated heat dissipates rapidly. This reduction in flame temperature reduces the formation of temperature-dependent nitrogen oxides. Additional oxygen 124 is discharged through the burner block outlet ports 140 into the second stage combustion zone 114 to complete combustion and optimize the flame shape and length.

Figure 10:
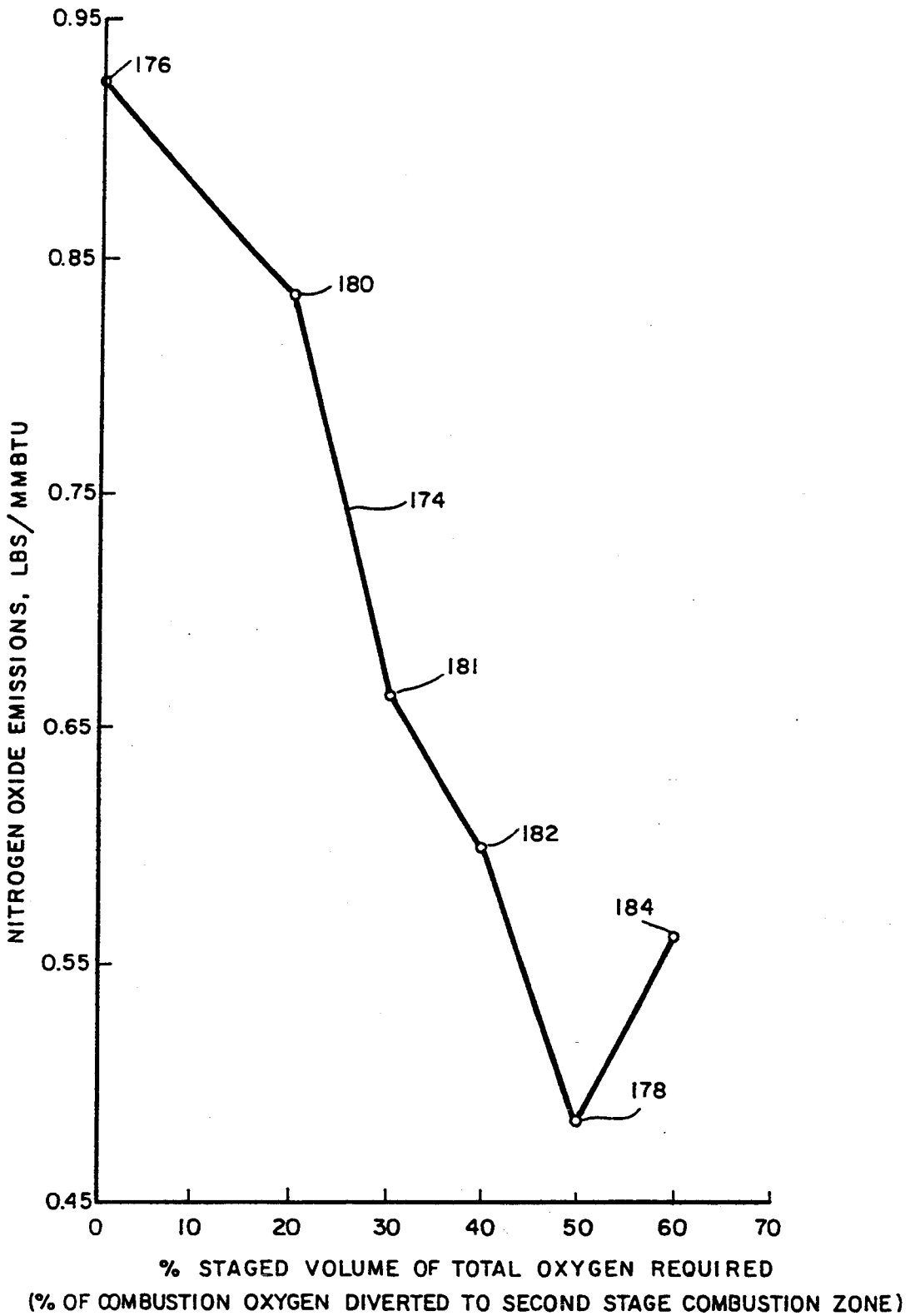
FIG. 10 is a graph illustrating the effectiveness of an oxygen staging system used with an atomizing burner firing USA No. 6 fuel oil in accordance with the present invention in reducing nitrogen oxide emissions.

As shown in FIG. 10, laboratory test data confirms that there is a dramatic reduction in nitrogen oxide emissions using burner assembly 10 in accordance with the present invention as compared to a standard oxygen-fuel burner of the type disclosed in U.S. Pat. No. 5,092,760 where no staged oxygen delivery is used. The above-noted standard oxygen-fuel burner was tested to provide baseline emissions numbers for comparison between staged and non-staged systems. Such a standard burner is available as Model No. Series 1000 from Maxon Corporation, P.O. Box 2068, Muncie, Ind. 47307-0068.

The test data illustrated in FIG. 10 was obtained by conducting a test using No. 6 fuel oil at a pressure of 41 psig, temperature of 200° F., and flow of 40 LPH. The oxygen-atomizing pressure was 50 psig and total oxygen flow was 2965 LPH. As shown in FIG. 10, the amount of nitrogen oxide decreased from a high of 0.933 lbs/MMBTU at point 176 on curve 174 when 100% of combustion oxygen was supplied as stream 122 and 0% of combustion oxygen was supplied as stream 124 to a low of 0.482 lbs/MMBTU at point 178 on curve 174 when 50% of combustion oxygen was supplied as stream 122 and 50% of combustion oxygen was supplied as stream 124. Point 180 on curve 174 represents 80% of combustion oxygen in stream 122 and 20% of combustion oxygen in stream 124. Point 181 on curve 174 represents 70% of combustion oxygen in stream 122 and 30% of combustion oxygen in stream 124. Point 182 on curve 174 represents 60% of combustion oxygen in stream 122 and 40% of combustion oxygen in stream 124. Point 184 on curve 174 represents 40% of combustion oxygen in stream 122 and 60% of combustion oxygen in stream 124. It is believed that a 50/50 split of staged and primary oxygen is optimum although this ratio may vary somewhat from furnace to furnace.

It has been observed that the oxygen-staging system in accordance with the present invention is applicable to natural gas or any fuel gas (e.g., propane, butane, etc.) burners as well as fuel oil burners. Reference is hereby made to the natural gas burner disclosed in U.S. Pat. No. 4,690,635, which disclosure is incorporated by reference herein. Recent testing reported in FIG. 12 has shown that testing the natural gas burner disclosed in the '635 patent in accordance with the staged oxygen system of the present invention also yields very low nitrogen oxide emissions.

Figure 11:
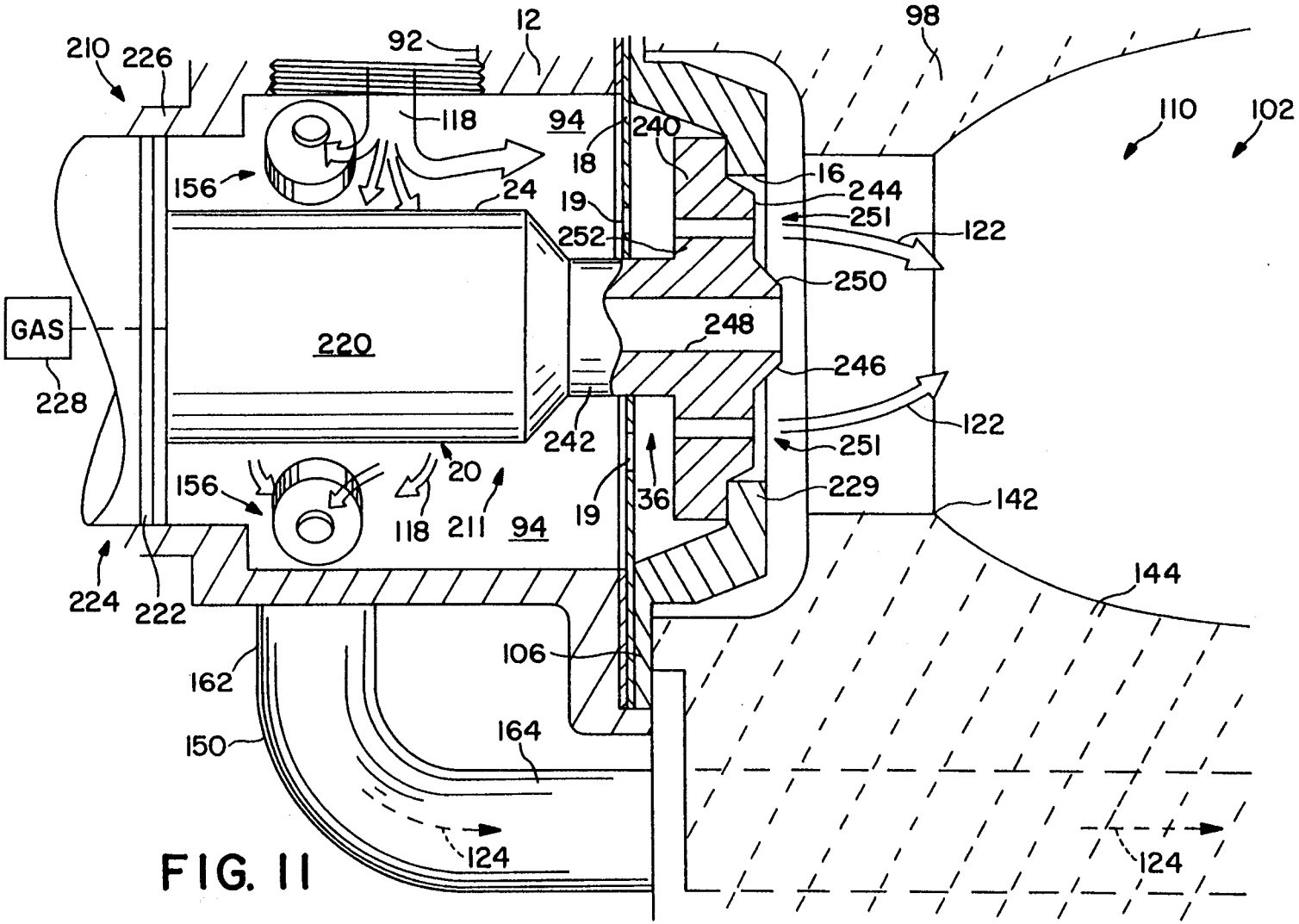
FIG. 11 is a view similar to FIG. 2 but showing a fuel gas burner nozzle mounted in the oxygen-supply manifold in place of the atomizing burner shown in FIG. 2.

As shown in FIG. 11, a burner assembly 210 is configured to include a natural gas burner 211 of the type disclosed in the above-noted U.S. Pat. No. 4,690,635. Illustratively, the burner 211 is mounted in the oxygen-supply manifold 94 in the manner shown in FIG. 11.

A gas conduit 220 is disposed within housing 12 and has means thereon for directing a gaseous fuel therethrough to be expelled from gas conduit 220 and to mix with the oxygen for burning in a sustainable flame. Gas conduit 220 may preferably have one or more O-ring seals 222 disposed at the rear portion 224 thereof for effectuating a seal with rear lip portion 226 of housing 12, and further includes a gas connection 228 disposed and extending rearwardly therefrom. Such housing 12 and gas conduit 20 are substantially sealed at the proximal portion 229 thereof by suitable pressure fit engagement techniques known to those of ordinary skill in the art. Such housing 12 further includes an oxygen inlet 92 which may be disposed upwardly as shown in FIG. 1, but such direction may be varied in other embodiments.

The housing 12 and gas conduit 220 contained therein are suitable for use in association with a refractory burner block 98 and are secured to housing 12 by means of block support holder. Such refractory burner block 98 includes a combustion chamber 102.

The natural gas burner 211 further includes a gas conduit tip 240 connected to gas conduit 20 by gas conduit channel 242 and includes a substantially flat exterior tip face surface 244. Exterior tip face 244 has a substantially frustoconical-shaped prominence 246 disposed thereon and protruding from tip face 244.

Gas conduit tip 240 also includes a central gas channel 248 centrally disposed therethrough and terminating at the proximal end of frustoconical-shaped prominence 246 to form substantially a knife edge shaped rim 250 thereon. Such knife edge shaped rim 250 structure functions to delay combustion for a few microseconds and to provide no substantial available surface for the accumulation of carbon thereon. The opening of central gas channel 248 is preferably disposed in a plane spaced at a selected distance away from the plane of tip face 244.

The oxygen-expelling orifice 251 illustratively comprises a plurality of oxygen holes 252 having diameters substantially smaller than that of central gas channel 248. In such preferred embodiment, oxygen holes 252 are disposed in a circular array, which array is substantially concentric with central gas channel 248. Such oxygen holes 252 may open onto top face 244, or in alternative preferred embodiments may open at the junction of tip face 244 and the base of the frustoconical-shaped prominence 246.

In operation, oxygen from oxygen-supply manifold 94 passes through oxygen holes 252 into the combustion chamber 102 to mix with natural gas or other gaseous fuel supplied through central gas channel 248. As in the case of the fuel oil burner embodiment shown in FIGS. 1 and 2, combustion occurs in a first stage combustion zone 110 and a second stream of oxygen 124 is conducted (illustratively through the burner block 98) to reach the downstream second stage combustion zone.

Figure 12:
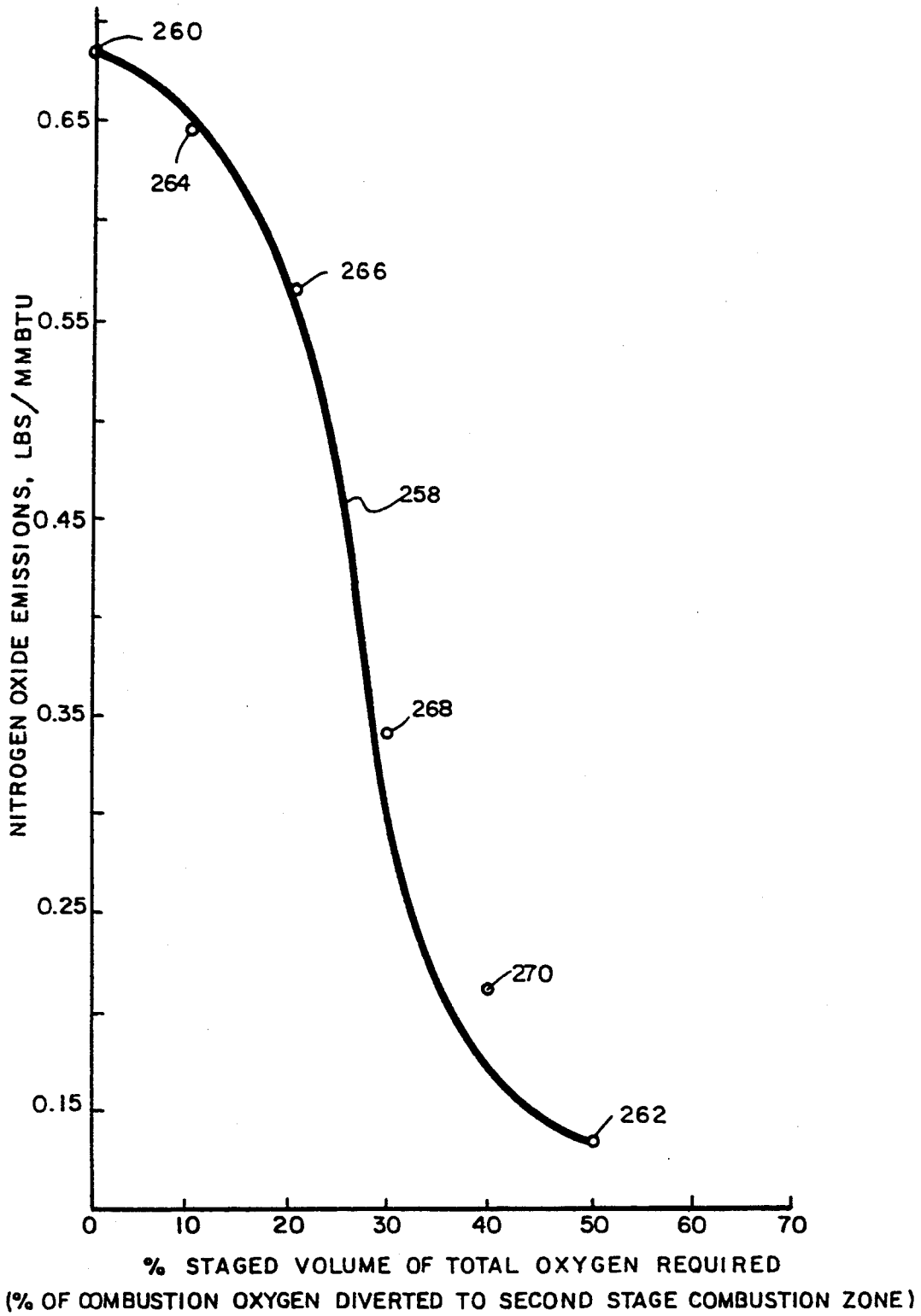
FIG. 12 is a graph illustrating the effectiveness of an oxygen staging system used with a fuel gas burner nozzle in accordance with the present invention in reducing nitrogen oxide emissions.

The test data illustrated in FIG. 12 was obtained by conducting a test using natural gas at a pressure of 8 psig, temperature of 70° F., and flow of 1500 SCFH. The oxygen flow was 3136 SCFH. As shown in FIG. 12, the amount of nitrogen oxide decreased from a high of 0.684 lbs/MMBTU at point 260 on curve 258 when 100% of combustion oxygen was supplied as stream 122 and 0% of combustion oxygen was supplied as stream 124 to a low of 0.134 lbs/MMBTU at point 262 on curve 258 when 50% of combustion oxygen was supplied as stream 124. Point 264 associated with curve 258 represents 90% of combustion oxygen in stream 122 and 10% of combustion oxygen in stream 124. Point 266 associated with curve 258 represents 80% of combustion oxygen in stream 122 and 20% of combustion oxygen in stream 124. Point 268 associated with curve 258 represents 70% of combustion oxygen in stream 122 and 30% of combustion oxygen in stream 124. Point 270 associated with curve 258 represents 60% of combustion oxygen in stream 122 and 40% of combustion oxygen in stream 124. This laboratory test data also confirms that there is a dramatic reduction in nitrogen oxide emissions using burner assembly 211.

Figure 7:
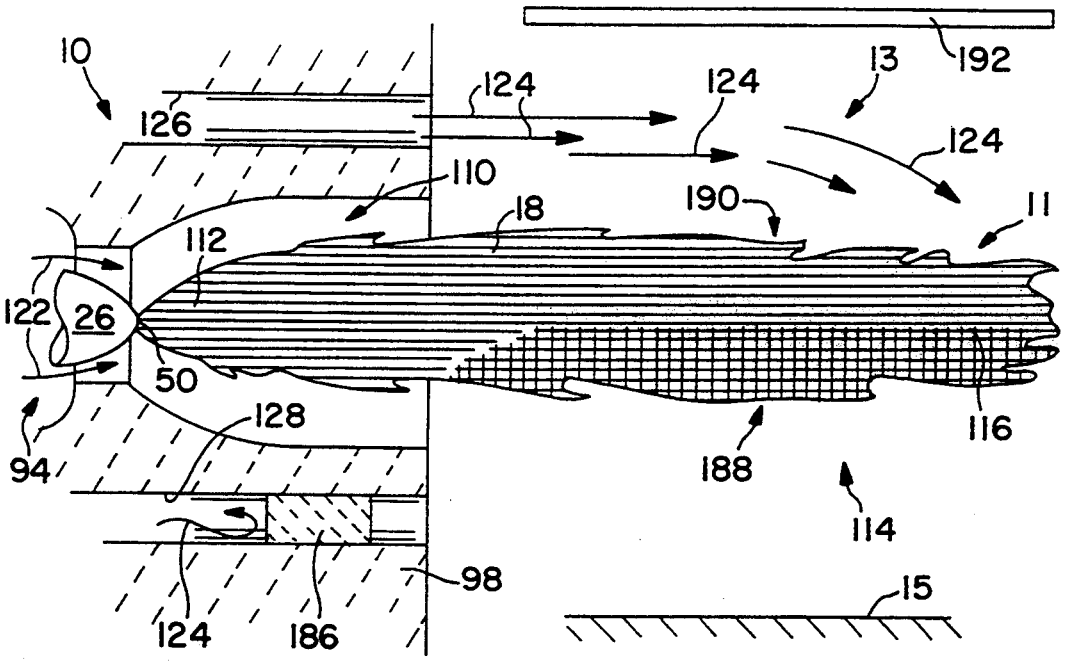
FIG. 7 is a diagrammatic view of the burner block and a portion of a glass-treating furnace downstream from the burner block showing one technique for plugging an oxygen-delivery passageway in the burner block to vary the luminosity, shape, and length of a flame produced by the burner assembly and arranged to lie above a piece of glass (or other object) moving through the furnace.
Figure 9:
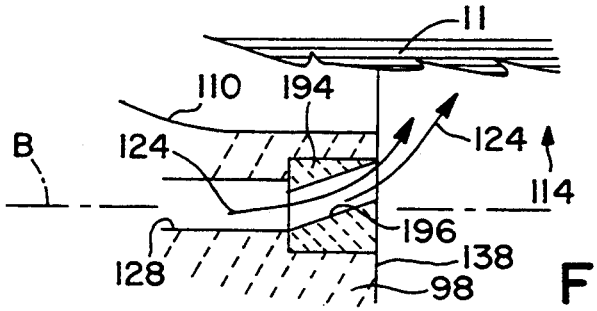
FIG. 9 is an alternative embodiment of the plug shown in FIG. 7 wherein the plug is formed to include a directional, angled flow-reduction aperture.

Referring now to FIGS. 7 and 9, it will be understood that various means can be used to change or vary the flow of combustion oxygen 124 that is discharged into the second stage combustion zone 114. Illustratively, plug 186 is mounted in oxygen-conducting passageway 128 to block the flow of oxygen stream 124 through the outlet opening 140 of passageway 128. By shutting off or varying the flow of combustion oxygen 124 through one or more of oxygen-conducting passageways 126, 128, 130, and 132, it is possible to control the luminosity and shape of flame 11. It has been observed that flame 11 tends to bend slightly toward an oxygen source and that a non-geometrically perfect flame may exhibit less nitrogen oxide (perhaps as a result of some imbalance in mixing fuel oil and oxygen).

Flame 11 includes a yellow luminous portion 188 and a "cooler" blue non-luminous portion 190 as shown diagrammatically in FIG. 7. In the glass industry, it is often preferred to produce a flame having a luminous portion 188 adjacent to glass 15 heated in furnace 13. Glass furnace operators typically prefer to position the "cooler" non-luminous portion 188 of the flame 11 facing the roof 192 of the furnace 13. This allows the roof 192 to run cooler, lose less heat, and extend its useful life. It has been observed that supplying oxygen to a flame causes the oxygen-rich portion of the flame to become more non-luminous.

As shown diagrammatically in FIG. 7, oxygen 124 is discharged into the second stage combustion zone 114 through passageway 126 but blocked by the plug from passing through passageway 128. This causes the upper portion 190 of flame 11 to become more non-luminous, thereby cooling furnace roof 192 somewhat. As shown in FIG. 9, a plug 194 formed to include an angled bore 196 extending therethrough can be used to regulate and aim oxygen flow discharged into the second combustion zone 114. Of course, the direction of oxygen flow discharged by plug 194 can be varied by rotating plug 194 in passageway 128 about longitudinal axis B.

Although the invention has been described in detail with reference to certain preferred embodiments, variations and modifications exist within the scope and spirit of the invention as described and defined in the following claims.

I claim:

1. A burner assembly for combining oxygen and fuel to produce a flame, the burner assembly comprising a burner block formed to include a combustion chamber having an inlet opening and an outlet opening, a plurality of oxygen-discharge ports around the outlet opening of the combustion chamber, and oxygen-conducting means for conducting oxygen through the burner block outside of the combustion chamber to the plurality of oxygen-discharge ports, a nozzle including means for discharging an oxygen and fuel mixture into the combustion chamber formed in the burner block, means for fixing the nozzle adjacent to the burner block to position the discharging means at the inlet opening of the combustion chamber so that a primary combustion zone is established in the combustion chamber between the inlet and outlet openings, means for supplying oxygen to the combustion chamber through the inlet opening so that the oxygen supplied by the supplying means mixes with the oxygen and fuel mixture discharged by the nozzle in a first stage region inside the combustion chamber to produce a combustible mixture that can be ignited to define a flame having a root portion in the combustion chamber and a tip portion outside the combustion chamber, and means for delivering oxygen into the oxygen-conducting means formed in the burner block so that it passes through the oxygen-discharge ports and is ejected into a downstream second stage region containing a portion of the flame and lying outside the combustion chamber to supplement oxygen supplied to the first stage region inside the combustion chamber by the supplying means, the delivery means including at least one oxygen-delivery tube formed to include a passageway therein communicating oxygen into the oxygen-conducting means formed in the burner block, the at least one oxygen-delivery tube having a first internal diameter, the delivery means further including a flow regulator plate formed to include a fixed-diameter oxygen-flow orifice having a fixed second internal diameter less than the first internal diameter the flow regulator plate being positioned relative to the at least one oxygen-delivery tube and with its orifice sized to regulate oxygen flow through the fixed-diameter oxygen-flow orifice with respect to the flow through the oxygen-conducting means formed in the burner block.

2. The burner assembly of claim 1, wherein the supplying means includes an oxygen-supply manifold and means for passing oxygen from the oxygen-supply manifold around the nozzle and into the combustion chamber through the inlet opening and the at least one oxygen-delivery tube includes an inlet for receiving oxygen from the oxygen-supply manifold and an outlet for dispensing oxygen into the oxygen-conducting means.

3. The burner assembly of claim 2, wherein the burner block is formed to include a plurality of oxygen-admission ports communicating with the oxygen-conducting means and the outlet of the at least one oxygen-delivery tube is coupled in fluid communication to the oxygen-admission ports to transmit oxygen from the at least one oxygen-delivery tube into the oxygen-conducting means formed in the burner block.

4. The burner assembly of claim 3, wherein the oxygen-conducting means includes a plurality of mutually parallel elongated passageways extending through the burner block and each passageway is arranged to connect one of the oxygen-admission ports to one of the oxygen-discharge ports.

5. The burner assembly of claim 4, wherein the nozzle has a longitudinally extending central axis, each of the passageways have longitudinally extending central axes, and the passageways are formed to position their central axes in circumferentially spaced-apart relation from one another and in equidistant radially outwardly spaced-apart relation from the central axis of the nozzle.

6. The burner assembly of claim 2, wherein the burner block is formed to include a plurality of oxygen-admission ports communicating with the oxygen-conducting means, each oxygen-delivery tube extends from the oxygen-supply manifold to the burner block, and each oxygen-delivery tube includes said inlet and said outlet.

7. The burner assembly of claim 6, wherein the nozzle has a longitudinally extending central axis, each oxygen-delivery tube is elbow-shaped and includes a first segment formed to include the inlet and coupled to the oxygen-supply manifold, a second segment formed to include the outlet and coupled to the burner block at an oxygen-admission port, and a curved middle segment arranged to interconnect the first and second segments.

8. The burner assembly of claim 7, wherein the flow regulator plate is appended to the first segment.

9. The burner assembly of claim 8, wherein the flow regulator plate is arranged to lie at the inlet of the at least one oxygen-delivery tube.

10. The burner assembly of claim 6, wherein the flow regulator plate is appended to the at least one oxygen-delivery tube at the inlet.

11. The burner assembly of claim 1, wherein the delivering means further includes an oxygen-supply manifold located adjacent to an outside wall of the burner block and a plurality of oxygen-delivery tubes are arranged to lie outside the burner block and extend in radially outwardly extending directions away from the oxygen-supply manifold and terminate at oxygen-admission ports formed in the burner block and arranged to communicate with the oxygen-conducting means.

12. The burner assembly of claim 1, wherein the burner block includes an outside wall formed to include the inlet opening and a furnace wall formed to include the outlet opening, the delivering means includes an oxygen-supply manifold coupled to the outside wall and a plurality of oxygen-delivery tubes, and each oxygen-delivery tube includes an inlet for receiving oxygen extant in the oxygen-supply manifold through the fixed-diameter oxygen-flow orifice in the flow regulator plate adjacent to said inlet and an outlet for discharging oxygen into the oxygen-conducting means.

13. The burner assembly of claim 12, wherein the supplying means includes means for forming a passageway around the nozzle and means for admitting oxygen from the oxygen-supply manifold into the passageway for transmission into the combustion chamber.

14. The burner assembly of claim 13, wherein the flow regulator plate is positioned to lie outside of said admitting means.

15. The burner assembly of claim 1, wherein the oxygen-conducting means includes a plurality of separate passageways extending through the burner block and terminating at the oxygen-discharge ports and further comprising means for plugging at least one of the separate passageways to regulate the flow of oxygen from the oxygen-conducting means into the downstream second stage region.

16. The burner assembly of claim 15, wherein the plugging means includes a plug and aperture means formed in the plug for passing oxygen from said at least one of the separate passageways into the downstream second state region.

17. The burner assembly of claim 16, wherein said at least one of the separate passageways has a longitudinally extending central axis and the aperture means has a central axis intersecting said longitudinally extending central axis to define an acute included angle therebetween.

18. The burner assembly of claim 1, wherein the delivering means further includes an oxygen-supply manifold formed to include an oxygen-discharge outlet, the at least one oxygen-delivery tube is formed to include an inlet, and the flow regulator plate is a removable plate positioned to lie between the oxygen:discharge outlet of the oxygen-supply manifold and the inlet of one of the oxygen-delivery tubes.

19. The burner assembly of claim 18, wherein the delivering means further includes a mounting plate lying around the inlet of said one of the oxygen-delivery tubes and engaging the removable plate defining the flow regulator wall and bolts connecting the mounting plate to the oxygen-supply manifold to trap the removable plate therebetween.

20. A burner assembly for combining oxygen and fuel to produce a flame, the burner assembly comprising a burner block formed to include a combustion chamber having an inlet opening and an outlet opening, a plurality of oxygen-discharge ports around the outlet opening of the combustion chamber, and oxygen-conducting means for conducting oxygen through the burner block outside of the combustion chamber to the plurality of oxygen-discharge ports, a nozzle including means for discharging an oxygen and fuel mixture into the combustion chamber formed in the burner block, means for fixing the nozzle adjacent to the burner block to position the discharging means at the inlet opening of the combustion chamber so that a primary combustion zone is established in the combustion chamber between the inlet and outlet openings, means for supplying oxygen to the combustion chamber through the inlet opening so that the oxygen supplied by the supplying means mixes with the oxygen and fuel mixture discharged by the nozzle in a first stage region inside the combustion chamber to produce a combustible mixture that can be ignited to define a flame having a root portion in the combustion chamber and a tip portion outside the combustion chamber, means for delivering oxygen into the oxygen-conducting means formed in the burner block so that it passes through the oxygen-discharge ports and is ejected into a downstream second stage region containing a portion of the flame and lying outside the combustion chamber to supplement oxygen supplied to the first stage region inside the combustion chamber by the supplying means the burner block including an outside wall formed to include the inlet opening and a furnace wall formed to include the outlet opening, the delivering means including an oxygen-supply manifold coupled to the outside wall and a plurality of oxygen-delivery tubes, and each oxygen-delivery tube including inlet means for receiving oxygen extant in the oxygen-supply manifold and outlet means for discharging oxygen into the oxygen-conducting means, and flow regulator means for regulating the flow rate of oxygen as it passes from one of the oxygen-delivery tubes into the oxygen-conducting means, the flow regulator means including a plate positioned to lie between said one of the oxygen-delivery tubes and the oxygen-conducting means formed in the burner block, and being formed to include aperture means therein for passing oxygen from said one of the oxygen-delivery tubes to the oxygen-conducting means formed in the burner block, and the aperture means having a fixed internal diameter that is less than the internal diameter of said one of the oxygen-delivery tubes and selected in size to properly apportion flow between the combustion in the first and second stage regions.

21. A burner assembly for combining oxygen and fuel to produce a flame, the burner assembly comprising a burner block formed to include a combustion chamber having an inlet opening and an outlet opening, oxygen-discharge means around the outlet opening of the combustion chamber for discharging oxygen from the burner block, and oxygen-conducting means for conducting oxygen through the burner block outside of the combustion chamber to the oxygen-discharge means, the oxygen-conducting means including a plurality of longitudinally extending passageways formed in the burner block and arranged to lie in spaced-apart relation from the combustion chamber, each longitudinally extending passageway having an inlet opening, a nozzle including means for discharging an oxygen and fuel mixture into the combustion chamber formed in the burner block, means for supplying oxygen to the combustion chamber through the inlet opening so that the oxygen mixes with the oxygen and fuel mixture discharged by the nozzle in a first stage region inside the combustion chamber to produce a combustible mixture that can be ignited to define a flame having a root portion in the combustion chamber and a tip portion outside the combustion chamber, means for delivering oxygen into the inlet opening of each longitudinally extending passageway formed in the oxygen-conducting means formed in the burner block so that it passes through the oxygen-conducting means and is ejected into a downstream second stage region containing a portion of the flame and lying outside the combustion chamber to supplement oxygen supplied to the first stage region inside the combustion chamber by the supplying means, and wherein the oxygen is ejected into the second stage region in a symmetrical pattern about the tip flame portion.

22. The burner assembly of claim 21, wherein the burner block includes an outside wall formed to include the inlet opening and a furnace wall formed to include the outlet opening, the delivering means includes an oxygen-supply manifold coupled to the outside wall and a plurality of oxygen-delivery tubes, and each oxygen-delivery tube includes inlet means for receiving oxygen extant in the oxygen-supply manifold and outlet means arranged symmetrically about the burner block for discharging oxygen into the oxygen-conducting means.

23. The burner assembly of claim 22, wherein the supplying means includes means for forming a passageway around the nozzle and means for admitting oxygen from the oxygen-supply manifold into the passageway for transmission into the combustion chamber.

24. A burner assembly for combining oxygen and fuel to produce a flame, the burner assembly comprising a burner block formed to include a combustion chamber having an inlet opening and an outlet opening, a nozzle including means for discharging an oxygen and fuel mixture into the combustion chamber formed in the burner block, means for fixing the nozzle adjacent to the burner block to position the discharging means at the inlet opening of the combustion chamber so that a primary combustion zone is established in the combustion chamber between the inlet and outlet openings, means for supplying oxygen to the combustion chamber through the inlet opening so that the oxygen supplied by the supplying means mixes with the oxygen and fuel mixture discharged by the nozzle in a first stage region inside the combustion chamber to produce a combustible mixture that can be ignited in the primary combustion zone to define a flame having a root portion in the combustion chamber and a tip portion outside the combustion chamber, and means for delivering oxygen from the supplying means into a downstream second stage region containing a portion of the flame and lying outside the combustion chamber to supplement oxygen supplied to the first stage region inside the combustion chamber by the supplying means, the delivering means including at least one passage way formed in the burner block and at least one oxygen-delivery tube interconnecting the supplying means and said at least one passageway formed in the burner block, the at least one oxygen-delivery tube having a first internal diameter and a plate therein formed to include a fixed-diameter oxygen-flow orifice having a fixed second internal diameter less than the first internal diameter to control the relative flow of oxygen between the two stages.

* * * * *